US009770908B2

(12) United States Patent
Machida et al.

(10) Patent No.: US 9,770,908 B2
(45) Date of Patent: Sep. 26, 2017

(54) INKJET HEAD AND INKJET RECORDING DEVICE

(71) Applicant: Konica Minolta, Inc., Chiyoda-ku, Tokyo (JP)

(72) Inventors: Yuichi Machida, Hachioji (JP); Masanori Shimazoe, Hino (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/102,709

(22) PCT Filed: Dec. 5, 2014

(86) PCT No.: PCT/JP2014/082215

§ 371 (c)(1),
(2) Date: Jun. 8, 2016

(87) PCT Pub. No.: WO2015/087796

PCT Pub. Date: Jun. 18, 2015

(65) Prior Publication Data

US 2016/0311223 A1 Oct. 27, 2016

(30) Foreign Application Priority Data

Dec. 12, 2013 (JP) ..... 2013-256845

(51) Int. Cl.
*B41J 2/135* (2006.01)
*B41J 2/14* (2006.01)
*B41J 2/155* (2006.01)

(52) U.S. Cl.
CPC ..... *B41J 2/1433* (2013.01); *B41J 2/135* (2013.01); *B41J 2/14233* (2013.01); *B41J 2/155* (2013.01);
(Continued)

(58) Field of Classification Search
CPC ..... B41J 2/1433; B41J 2/155; B41J 2/14233; B41J 2/15; B41J 2/135; B41J 2/51;
(Continued)

(56) References Cited

U.S. PATENT DOCUMENTS 8,591,003 B2 * 11/2013 Kusakari ..... B41J 2/14233 347/40
2005/0001881 A1 * 1/2005 Nakashima ..... B41J 2/14233 347/50
2007/0132815 A1 * 6/2007 Sakaida ..... B41J 2/14209 347/85

FOREIGN PATENT DOCUMENTS

CN 1769053 A 5/2006
CN 102026814 A 4/2011
(Continued)

OTHER PUBLICATIONS

International Search Report corresponding to Application No. PCT/JP2014/082215; Date of Mailing: Mar. 3, 2015, with English translation.

(Continued)

*Primary Examiner* — Sharon A Polk
(74) *Attorney, Agent, or Firm* — Cantor Colburn LLP

(57) ABSTRACT

An inkjet head may include a plurality of nozzle holes that is two-dimensionally located in a nozzle formation surface facing a recording surface of a recording medium in a first direction parallel to a main-scanning direction orthogonal to a conveyance direction of the recording medium and in a sub-scanning direction parallel to the conveyance direction of the recording medium. Two nozzle holes that form dots adjacent in the main-scanning direction may be dispersedly located so as not to be adjacent in the sub-scanning direction. The two nozzle holes that form dots adjacent in the main-scanning direction are not separately located at one end and the other end in the sub-scanning direction of the plurality of nozzle holes that is two-dimensionally located.

6 Claims, 8 Drawing Sheets

(52) U.S. Cl.
CPC ..... *B41J 2002/14459* (2013.01); *B41J 2002/14491* (2013.01); *B41J 2202/11* (2013.01); *B41J 2202/20* (2013.01)

(58) Field of Classification Search
CPC ..... B41J 2/512; B41J 2/515; B41J 2002/11; B41J 2002/20
See application file for complete search history.

(56) References Cited

FOREIGN PATENT DOCUMENTS

| | | | |
|---|---|---|---|
| JP | H0624005 | A | 2/1994 |
| JP | 2004090504 | A | 3/2004 |
| JP | 2006272880 | A | 10/2006 |
| JP | 4487826 | B2 | 6/2010 |
| JP | 2012035573 | A | 2/2012 |
| JP | 2012116040 | A | 6/2012 |

OTHER PUBLICATIONS

Chinese First Office Action corresponding to Application No. 201480066773.8; Issue Date: Oct. 19, 2016, with Engligh translation.

* cited by examiner

INKJET HEAD AND INKJET RECORDING DEVICE

This is the U.S. national stage of application No. PCT/JP2014/082215, filed on Dec. 5, 2014. Priority under 35 U.S.C. §119(a) and 35 U.S.C. §365(b) is claimed from Japanese Application No. 2013-256845, filed Dec. 12, 2013, the disclosure of which is also incorporated herein by reference.

TECHNICAL FIELD

The present invention relates to an inkjet head and an inkjet recording device.

BACKGROUND ART

In an inkjet head of Patent Literature 1, as illustrated in FIG. 8, a plurality of nozzle holes is formed in matrix in a nozzle formation surface facing a recording surface of a recording medium so as to be arranged in a first direction parallel to a main-scanning direction orthogonal to a conveyance direction of the recording medium and in a second direction that is slightly inclined with respect to a sub-scanning direction serving as the conveyance direction of the recording medium.

In this inkjet head, nozzle holes n1 to n7 (defined to be a nozzle line N11) arranged in the second direction are located at a dot pitch P0 in the main-scanning direction, and the nozzle hole n7 on the most downstream side in the sub-scanning direction of the nozzle line N11 and a nozzle hole n8 on the most upstream side in the sub-scanning direction of an adjacent nozzle line N12 are also located at a pitch P2 equal to the dot pitch P0 in the main-scanning direction. Furthermore, the nozzle holes in the other nozzle lines N12, N13, N14, . . . are similarly located.

Although not illustrated, flow channels through which ink is supplied and driving mechanisms for ejecting ink are individually provided in a nozzle plate in which the nozzle holes are provided. When the nozzle holes are dispersedly located in the first and second directions as described above, location of the individual flow channels and the like is simplified while the dot pitch is reduced.

However, the above inkjet head is problematic in that, when inclination is generated in a direction of A1 or A2 in the figure due to a mounting error or the like of a body of the device, a change in the pitch P2 between the nozzle holes n7 and n8 tends to be larger than pitches between the other nozzle holes, and therefore light or shade is generated on a formed image along a line passing between the nozzle holes n7 and n8.

This problem arises because a pitch P4 in the sub-scanning direction between the nozzle hole n7 and the nozzle hole n8 is larger than a pitch P3 in the sub-scanning direction between other adjacent nozzle holes n1 to n7.

In order to solve the above problem, as illustrated in FIG. 9, in an inkjet head of Patent Literature 2, a nozzle hole n4 is located between a nozzle hole n7 and a nozzle hole n8 at a pitch P5 in a main-scanning direction and at a pitch P6 in a sub-scanning direction (P5=P2 (the pitch P2 in the main-scanning direction between the nozzle hole n7 and the nozzle hole n8 in FIG. 8), P6=P4/2).

With this, the pitch P6 in the sub-scanning direction between the nozzle holes n7 and n4 and the nozzle holes n4 and n8 which form adjacent dots can be formed to be a half of the pitch P4, and therefore an influence of a mounting error of the inkjet head can be reduced by half.

CITATION LIST

Patent Literature

Patent Literature 1: JP 2004-90504 A
Patent Literature 2: Japanese Patent No. 4487826

SUMMARY OF INVENTION

Technical Problem

As described above, in the inkjet head of Patent Literature 1, reduction in a nozzle pitch and simplification of location of configurations for ejecting ink in the head are achieved. Patent Literature 2 achieves, in addition to the above points, prevention of reduction in image quality caused by a mounting error of the inkjet head.

However, an influence of generation of resonance caused by ejection of ink has not been considered in those conventional inkjet heads. That is, resonance is generated in the vicinity of a nozzle of an inkjet head when an oscillation frequency caused by ejection of ink is close to a resonance frequency based on a structure thereof. It is problematic in that, when the resonance is generated, an ejection speed is changed to be higher or lower than a normal speed in nozzle holes in the vicinity thereof, thereby influencing image quality. Such an influence of the resonance is more remarkable in the nozzle holes located closer to the nozzle hole that has ejected ink.

In the inkjet heads of Patent Literature 1 and Patent Literature 2, most nozzle holes are located so that nozzle holes that form adjacent dots are adjacent in the second direction. Two nozzle holes that form adjacent dots perform ejection at the same timing in many cases, and therefore it is problematic in that, in the case where those nozzle holes are located to be adjacent to each other, the influence of the resonance cannot be avoided.

An object of the present invention is to reduce an influence of resonance caused by ejection while reducing an influence of a mounting error of an inkjet head.

Solution to Problem

An inkjet head of the present invention includes a plurality of nozzle holes that is two-dimensionally located in a nozzle formation surface facing a recording surface of a recording medium in a first direction parallel to a main-scanning direction orthogonal to a conveyance direction of the recording medium and in a sub-scanning direction parallel to the conveyance direction of the recording medium, wherein two nozzle holes that form dots adjacent in the main-scanning direction are dispersedly located so as not to be adjacent in the sub-scanning direction, and the two nozzle holes that form dots adjacent in the main-scanning direction are not separately located at one end and the other end in the sub-scanning direction of the plurality of nozzle holes that is two-dimensionally located.

In the inkjet head according to the present invention, the plurality of nozzle holes may be divided into a plurality of nozzle formation areas in which the nozzle holes are arranged in the first direction and in a second direction inclined with respect to the sub-scanning direction, the plurality of nozzle formation areas may be arranged in the sub-scanning direction, and the two nozzle holes that form dots adjacent in the main-scanning direction may be dispersedly located so as not to be in the same nozzle formation area, and the two nozzle holes that form dots adjacent in the main-scanning direction may not be separately located at one end and the other end in the sub-scanning direction in the whole region including the plurality of nozzle formation areas.

In the inkjet head according to the present invention, the nozzle holes may be allocated to the plurality of nozzle formation areas in order in accordance with arrangement order of dots to be formed in the main-scanning direction, and arrangement order of the plurality of nozzle formation areas in the sub-scanning direction may be changed so that the two nozzle holes that form dots adjacent in the main-scanning direction are not separately located at the one end and the other end in the sub-scanning direction in the whole region including the plurality of nozzle formation areas.

In the inkjet head according to the present invention, in each of the nozzle formation areas, the nozzle holes may be allocated in order from one end of a line including a plurality of nozzle holes arranged in the second direction.

In the inkjet head according to the present invention, a nozzle formation area in which the nozzle holes are allocated in order from one end of a line including a plurality of nozzle holes arranged in the second direction may coexist with a nozzle formation area obtained by inverting, around an axis in the main-scanning direction, the nozzle formation area in which the nozzle holes are allocated in order from the one end of the line including the plurality of nozzle holes arranged in the second direction.

The inkjet head according to the present invention may include: a pressure chamber substrate in which a plurality of pressure chambers individually communicating with the plurality of nozzle holes is provided; a diaphragm forming a part of inner walls of the plurality of pressure chambers; and a plurality of piezoelectric elements that individually change internal pressures of the plurality of pressure chambers, the piezoelectric elements being provided outside apart of the diaphragm serving as the inner walls of the plurality of pressure chambers.

In the inkjet head according to the present invention, a nozzle pitch in the main-scanning direction may be an integral multiple of a dot pitch in the main-scanning direction, and a nozzle pitch in the sub-scanning direction may be an integral multiple of a dot pitch in the sub-scanning direction.

An inkjet recording according to the present invention device includes: a conveyance mechanism that conveys the recording medium; and the inkjet head.

Advantageous Effects of Invention

The present invention can reduce an influence of resonance caused by ejection of ink because two nozzle holes that form dots adjacent in a main-scanning direction are dispersedly located in an inkjet head so as not to be adjacent in a sub-scanning direction.

Furthermore, two nozzle holes that form adjacent dots are not separately located at one end and the other end in the sub-scanning direction of a plurality of nozzle holes that is two-dimensionally located, and therefore it is possible to reduce an influence of a change in distance between adjacent dots, the influence being caused by a mounting error of the inkjet head.

Therefore, it is possible to provide an inkjet head and an inkjet recording device which are capable of reducing an influence of resonance caused by ejection of ink while suppressing an influence of inclination caused by a mounting error of the inkjet head.

DESCRIPTION OF EMBODIMENTS

Overview of Embodiment

Hereinafter, a preferred embodiment of the present invention will be described with reference to the drawings.

Figure 1:
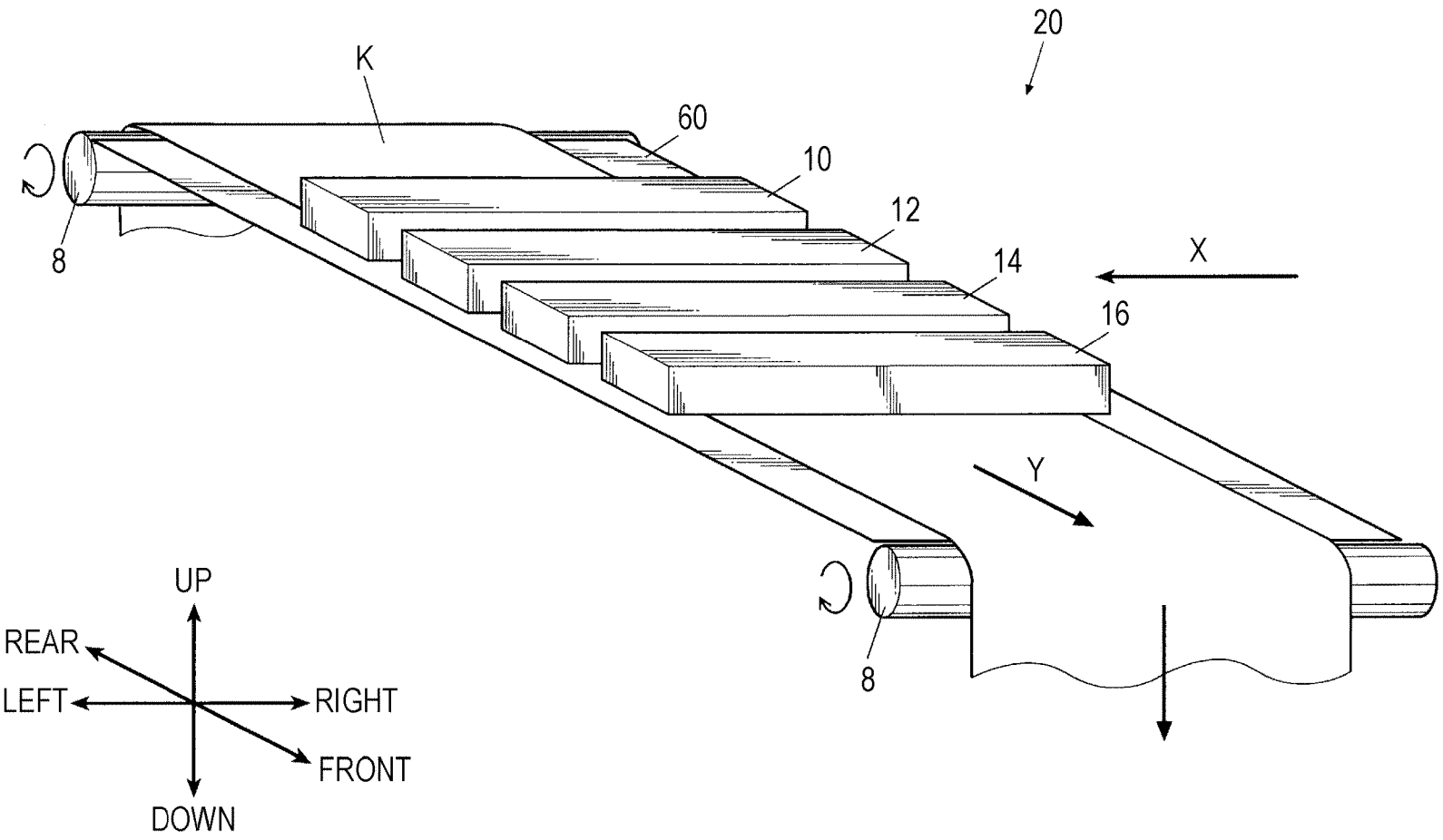
FIG. 1 is a perspective view illustrating a schematic configuration of a main part of an inkjet recording device according to an embodiment to which the present invention is applied.

As illustrated in FIG. 1, an inkjet recording device 20 includes a platen 60 for supporting a recording medium K. Conveyance rollers 8 serving as a conveyance mechanism for conveying the recording medium K are provided before and after the platen 60. When the conveyance rollers 8 are driven, the recording medium K is conveyed from a rear side toward a front side while being supported by the platen 60.

In the following description, a conveyance direction of the recording medium K is referred to as "sub-scanning direction Y", and a direction that is parallel to a recording surface of the recording medium K and orthogonal to the conveyance direction is referred to as "main-scanning direction X". Both the sub-scanning direction Y and the main-scanning direction X are horizontal.

Line heads 10, 12, 14, and 16 are provided above the platen 60 from an upstream side to a downstream side in the sub-scanning direction Y. The line heads 10, 12, 14, and 16 extend in the X direction and eject ink of process colors of Y, M, C, and K, respectively, toward the recording medium K.

Figure 2:
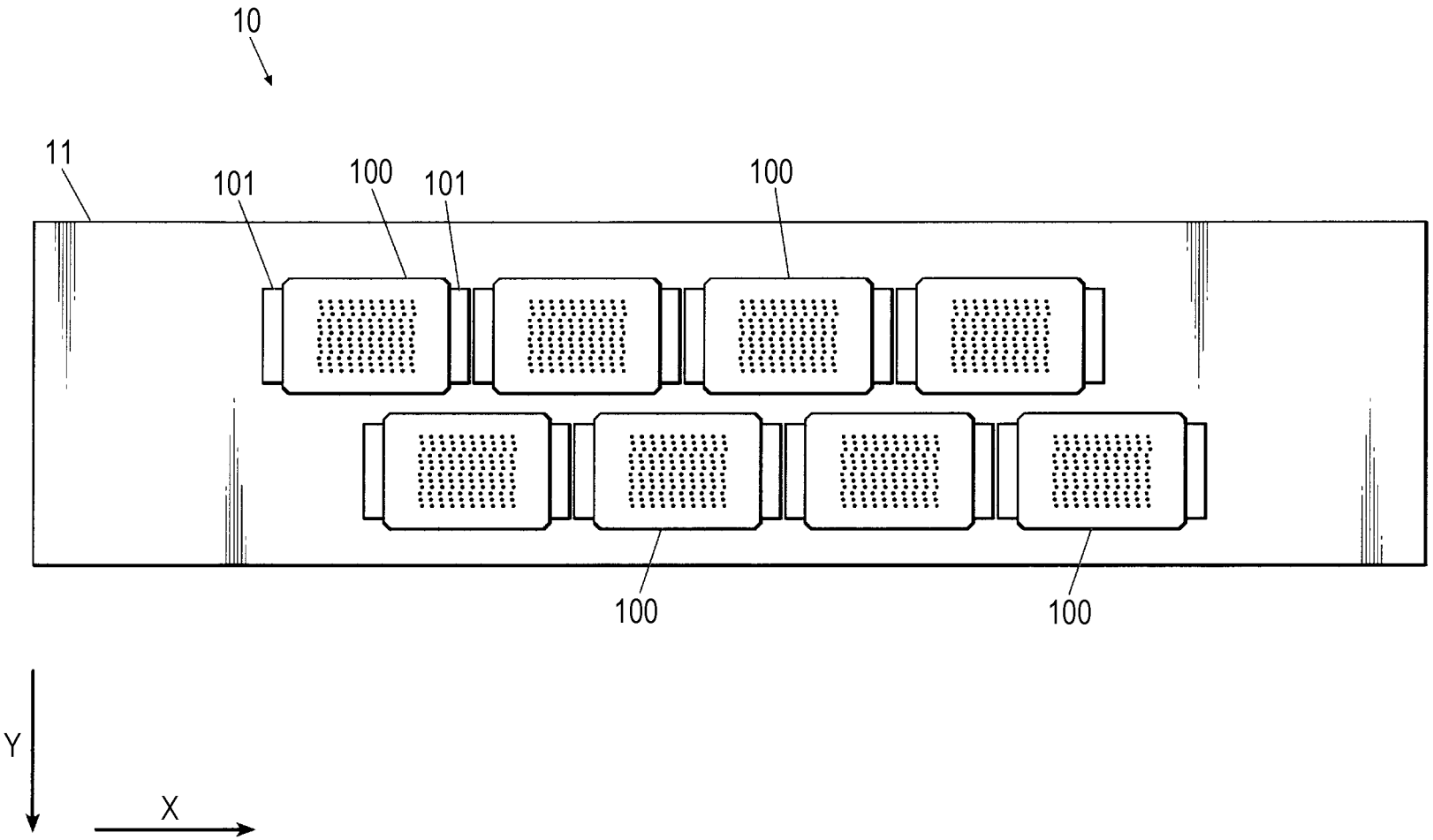
FIG. 2 is a bottom view of a line head, illustrating location of inkjet heads.

As illustrated in FIG. 2, when the line head 10 is seen from below, eight inkjet heads 100 are arrayed in zigzag in the main-scanning direction X.

The inkjet head 100 includes a substantially rectangular parallelepiped housing (not illustrated), and a nozzle substrate 1 is provided in a bottom portion of the housing so as to face the recording surface of the recording medium K in parallel. A flange 101 is integrally provided in left and right side portions of the housing. The inkjet head 100 is fixed to a support member 11 of the line head 10 by the flange 101.

Note that the line heads 10, 12, 14, and 16 are an example of a line head module, and the line heads 12, 14, and 16 have configurations similar to a configuration of the line head 10.

[Structure in the Vicinity of Nozzle Hole]

Figure 3:
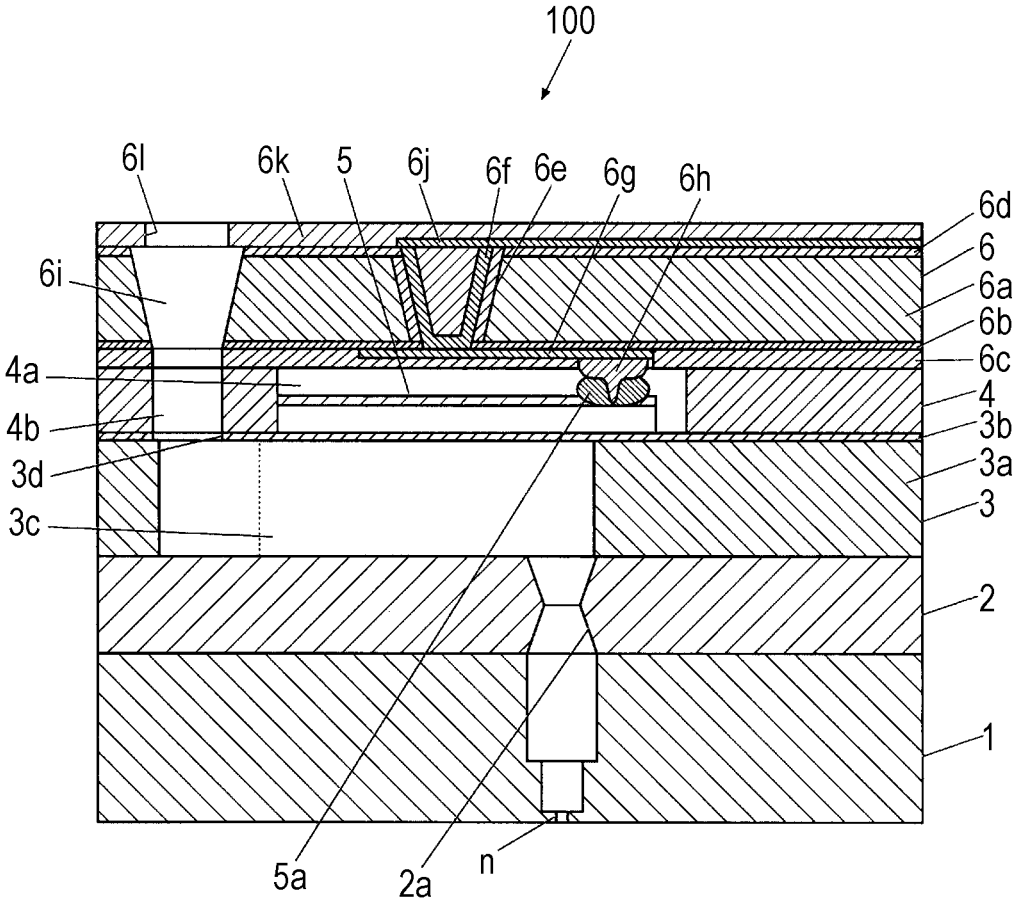
FIG. 3 is a cross-sectional view illustrating a periphery of a nozzle hole in an inkjet head.

FIG. 3 is a cross-sectional view illustrating a vertical cross-section passing through a nozzle hole n. A structure in the vicinity of the nozzle hole n will be described with reference to FIG. 3.

The inkjet head 100 is configured by laminating the nozzle substrate 1, a first adhesion substrate 2, a pressure chamber substrate 3, a second adhesion substrate 4, a piezoelectric element 5, and a wiring board 6 in this order.

The nozzle substrate 1 is positioned at the undermost layer of the inkjet head 100. The nozzle substrate 1 is, for example, a substrate made of silicon. A bottom surface of the nozzle substrate 1 is a nozzle formation surface facing the recording medium K, and the plurality of nozzle holes n is formed to vertically penetrate the nozzle substrate 1.

The first adhesion substrate 2 is laminated on a top surface of the nozzle substrate 1 and is bonded thereto. The first adhesion substrate 2 is, for example, a substrate made of glass. In the first adhesion substrate 2, a through hole 2*a* communicating with the nozzle hole n of the nozzle substrate 1 to form an ink flow channel is formed.

The pressure chamber substrate 3 is laminated on a top surface of the first adhesion substrate 2 and is bonded thereto.

The pressure chamber substrate 3 includes a pressure chamber layer 3*a* and a diaphragm 3*b*.

The pressure chamber layer 3*a* is laminated on the top surface of the first adhesion substrate 2 and is bonded thereto. The pressure chamber layer 3*a* is formed of a substrate made of silicon. In the pressure chamber layer 3*a*, a pressure chamber 3*c* for applying an ejection pressure to ink to be ejected through the nozzle hole n is formed to penetrate the pressure chamber layer 3*a*.

The pressure chamber 3*c* is formed above the through hole 2*a* and the nozzle hole n and communicates with the through hole 2*a* and the nozzle hole n.

The diaphragm 3*b* is laminated on a top surface of the pressure chamber layer 3*a* to cover an opening of the pressure chamber 3*c* and is bonded thereto. That is, the diaphragm 3*b* forms an upper wall portion of the pressure chamber 3*c*. Furthermore, for example, an oxide film is provided on a surface of the diaphragm 3*b*.

The second adhesion substrate 4 is laminated on a top surface of the diaphragm 3*b* and is bonded thereto.

The second adhesion substrate 4 is laminated on the top surface of the diaphragm 3*b*. The second adhesion substrate 4 is made of, for example, photosensitive resin. In the second adhesion substrate 4, a space portion 4*a* accommodating the piezoelectric element 5 is formed. The space portion 4*a* is formed above the pressure chamber 3*c* so as to penetrate the second adhesion substrate 4.

The piezoelectric element 5 is formed to have substantially the same plan-view shape as the pressure chamber 3*c* and is provided at a position facing the pressure chamber 3*c* via the diaphragm 3*b*. The piezoelectric element 5 is an actuator made of PZT (lead zirconium titanate) for deforming the diaphragm 3*b*. An electrode (not illustrated) provided on a bottom surface of the piezoelectric element 5 is connected to the diaphragm 3*b*.

In the second adhesion substrate 4, a through hole 4*b* communicating with a communication hole 3*d* of the pressure chamber substrate 3 is formed to be separated from the space portion 4*a*.

The wiring board 6 is laminated on a top surface of the second adhesion substrate 4 and is bonded thereto.

The wiring board 6 includes an interposer 6*a* that is, for example, a substrate made of silicon. For example, two insulating layers 6*b* and 6*c* made of silicon oxide are coated on a bottom surface of the interposer 6*a*, and an insulating layer 6*d* made of silicon oxide is similarly coated on a top surface thereof. The insulating layer 6*c*, which is positioned on a lower side between the two insulating layers 6*b* and 6*c* below the interposer 6*a*, is laminated on the top surface of the second adhesion substrate 4 and is bonded thereto.

A through hole 6*e* is formed in the interposer 6*a* in a lamination direction, and a through electrode 6*f* is inserted into the through hole 6*e*. One end of a lower wire 6*g* extending in a horizontal direction is connected to a lower end of the through electrode 6*f*. A stud bump 6*h* exposed in the space portion 4*a* is provided on the other end of the lower wire 6*g* and is connected to a conductive paste 5*a* provided in an electrode (not illustrated) on a top surface of the piezoelectric element 5. The lower wire 6*g* is protected by being interposed between the two insulating layers 6*b* and 6*c* below the interposer 6*a*.

In the interposer 6*a*, an inlet 6*i* communicating with the through hole 4*b* of the second adhesion substrate 4 is formed to vertically penetrate the interposer 6*a*.

On a top surface of the wiring board 6, an upper wire 6*j* having one end connected to an upper end of the through electrode 6*f* and the other end connected to an electrical connector (not illustrated) via a relay substrate (not illustrated) or the like is provided.

An adhesion layer 6*k* is formed to cover a top surface of the upper wire 6*j* on the top surface of the wiring board 6 and a top surface of the insulating layer 6*d* of the interposer 6*a*. The adhesion layer 6*k* is made of, for example, photosensitive resin for causing the inkjet head 100 to adhere to a retainer plate (not illustrated). The adhesion layer 6*k* also serves as a protection layer for protecting the upper wire 6*j*. In the adhesion layer 6*k*, a through hole 6*l* communicating with the inlet 6*i* is formed.

The communication hole 3*d*, the through holes 2*a*, 4*b*, and 6*l*, and the inlet 6*i* of the inkjet head 100 form an ink flow channel, and ink of an ink chamber (not illustrated) is supplied to the nozzle hole n via this ink flow channel.

Note that the above ink flow channel, the pressure chamber 3*c*, the piezoelectric element 5, a wiring structure of the piezoelectric element 5, and the like are individually provided for each of the plurality of nozzle holes n.

[Location of Nozzle Holes]

Figure 4:
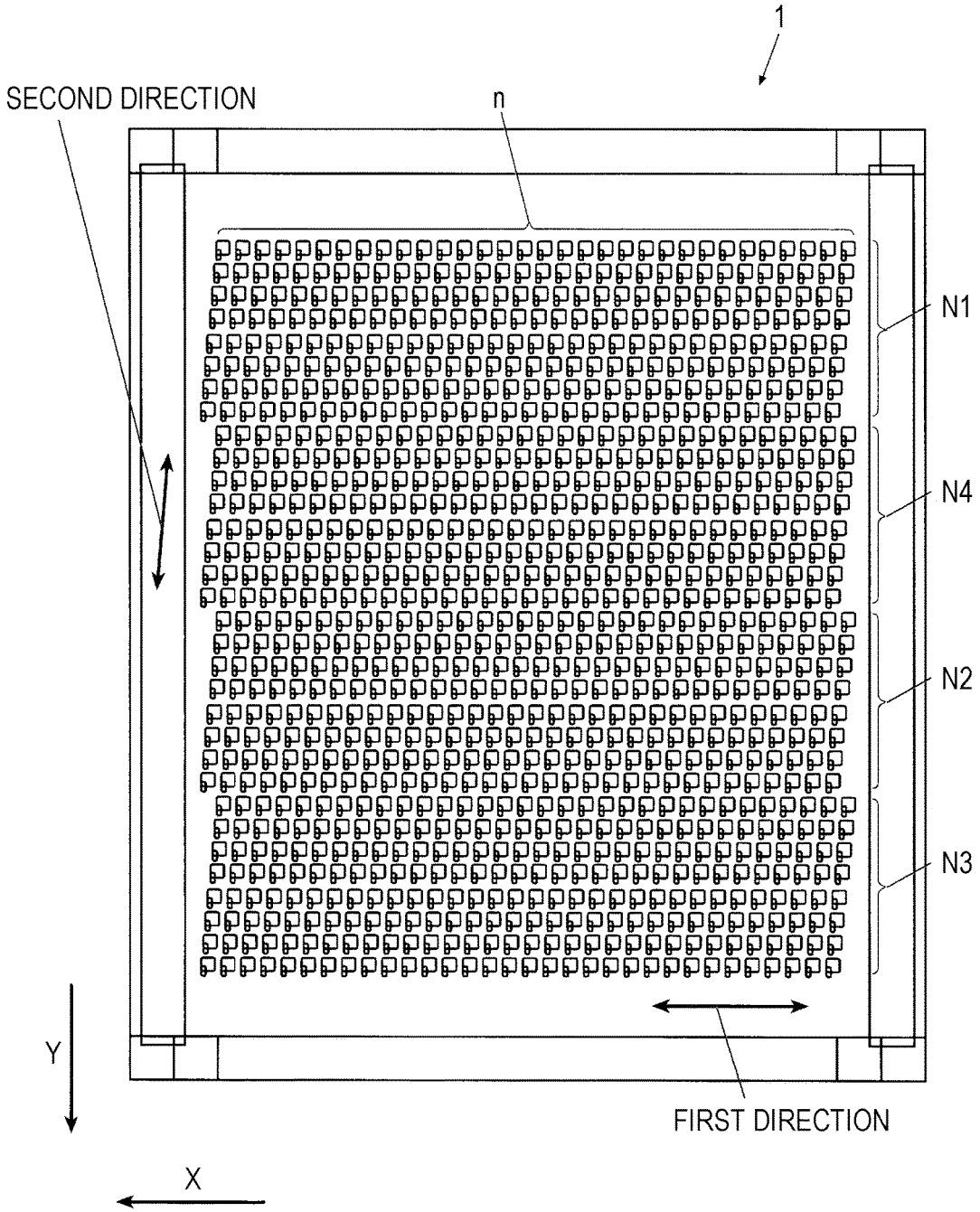
FIG. 4 is a plan view of a nozzle substrate.

Location of the plurality of nozzle holes n formed in the nozzle substrate 1 of the inkjet head 100 will be described with reference to FIGS. 4 to 6. FIG. 4 is a plan view of the nozzle substrate 1 seen from above.

In the inkjet head 100, dots can be formed at a dot pitch dpx in the main-scanning direction X and at a dot pitch dpy in the sub-scanning direction Y (not shown because those are setting values for control). All the nozzle holes n formed in the nozzle substrate 1 individually correspond to all dots D formed at the dot pitch dpx in the main-scanning direction X within a dot formable range of the inkjet head 100 (see FIG. 5).

As illustrated in FIG. 4, the nozzle holes n are arranged in matrix in the first direction and the second direction within four nozzle formation areas N1 to N4 having a parallelogram shape in parallel to the first direction and the second direction.

The first direction is parallel to the main-scanning direction X, and the second direction is not parallel to the main-scanning direction X and is slightly inclined with respect to the sub-scanning direction Y.

All the above four nozzle formation areas N1 to N4 are parallelograms which are long in the main-scanning direction X and have the same direction and the same size. The nozzle formation areas N1 to N4 are arrayed in predetermined order in the sub-scanning direction Y. Such order will be described below.

Herein, dispersed location of the nozzle holes n will be described with reference to FIG. 5. FIG. 5 is a comparative example that is different from FIG. 4 in arrangement order of the nozzle formation areas N1 to N4. In FIG. 5, circles with numbers show location of the nozzle holes n when the nozzle substrate 1 is seen from above. Each number in the circle indicates which dot D counted from an upstream end in the main-scanning direction X (right end in FIG. 5) among the dots D arranged in the main-scanning direction X the nozzle hole n ejects.

Note that, in order to facilitate understanding, an angle of inclination of the second direction with respect to the sub-scanning direction Y is increased in FIG. 5 and FIG. 6 described below.

In the case where two nozzle holes n, n that form dots adjacent in the main-scanning direction X are located to be close to each other and resonance caused by ejection of ink is generated, an ejection speed of the other nozzle hole n is changed to cause reduction in image quality. For this reason, it is desirable that the two nozzle holes n, n that form adjacent dots be dispersedly located so as not to be in the same nozzle formation area.

Figure 5:
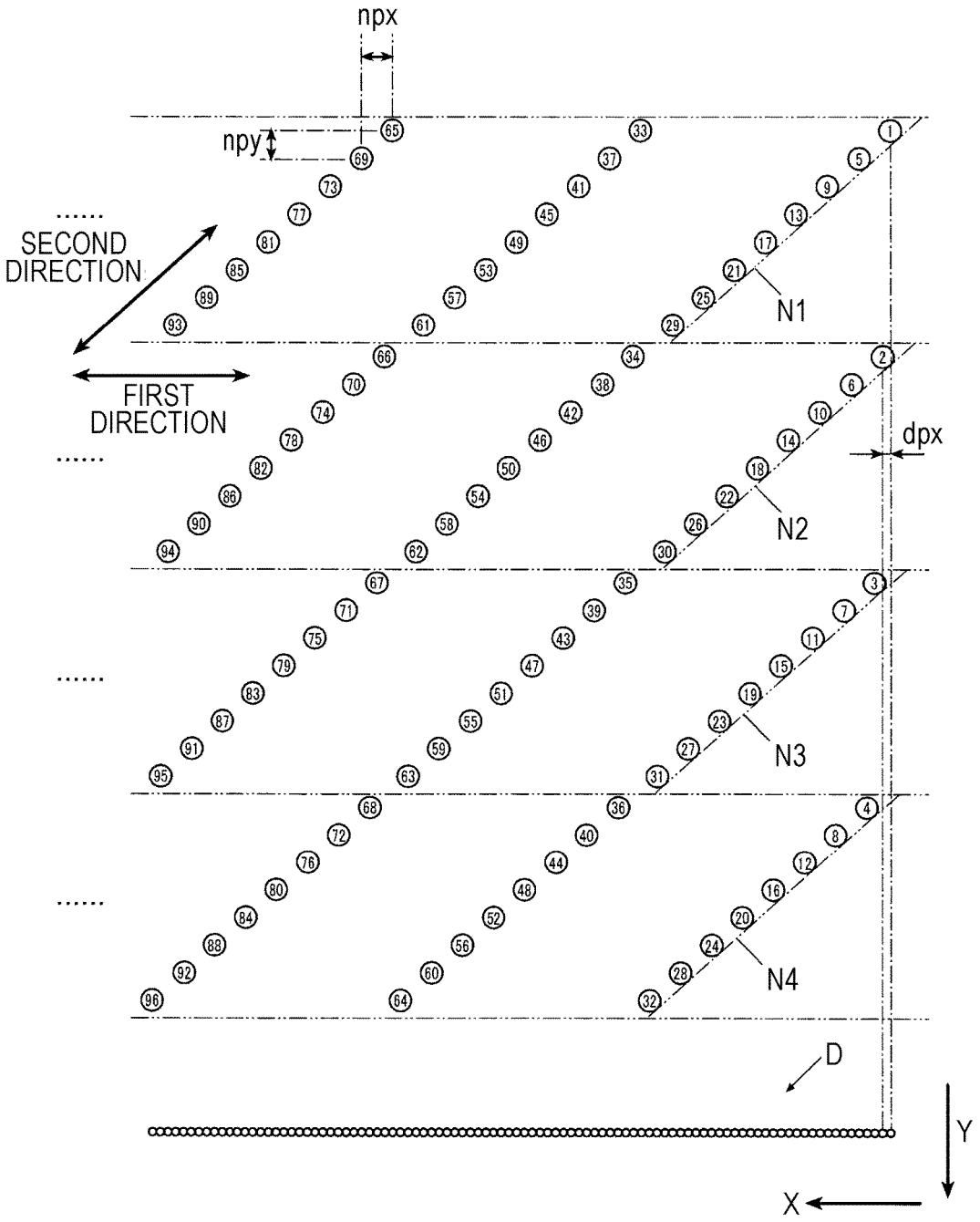
FIG. 5 is a view illustrating dispersed location of nozzle holes.

In the comparative example of FIG. 5, the nozzle holes n corresponding to arrangement order of the dots are allocated in order to the nozzle formation areas N1 to N4 arranged in order in the sub-scanning direction Y. That is, the nozzle hole n corresponding to the (4k+1)th dot is located in the nozzle formation area N1, the nozzle hole n corresponding to the (4k+2)th dot is located in the nozzle formation area N2, the nozzle hole n corresponding to the (4k+3)th dot is located in the nozzle formation area N3, and the nozzle hole n corresponding to the (4k+4)th dot is located in the nozzle formation area N4 (where k=0, 1, 2, 3, . . . ).

That is, in the nozzle formation areas N1 to N4, the prescribed number (for example, eight) of nozzle holes n is arranged in the second direction so that nozzle holes of a dot and another dot fourth away therefrom are adjacent, and the prescribed number (for example, 32) of lines of nozzles including the above prescribed number of nozzle holes n are formed at certain intervals in the first direction.

A nozzle pitch between the nozzle holes n, n adjacent in the second direction in each of the nozzle formation areas N1 to N4 is npx in the main-scanning direction X and npy in the sub-scanning direction Y.

The nozzle pitch npx in the main-scanning direction X is four times as large as the dot pitch dpx in the main-scanning direction X because nozzle holes of a dot and another dot fourth away therefrom are adjacent.

Although the nozzle pitch npy in the sub-scanning direction Y is arbitrary, it is desirable that the nozzle pitch npy be an integral multiple of the dot pitch dpy in the sub-scanning direction Y in terms of a relationship between a conveyance speed of the recording medium K and synchronization of ink ejection timings of the nozzle holes n.

Note that the second direction is $\theta=\tan^{-1}(npx/npy)$ where $\theta$ denotes an angle of inclination with respect to the sub-scanning direction Y.

Because allocation of the nozzle holes n corresponding to the arrangement order of the dots D is performed with the above method, end positions of the nozzle formation areas N1 to N4 in the main-scanning direction X are offset in order by the dot pitch dpx from the nozzle formation area N1 toward a downstream side in the main-scanning direction X.

When the nozzle holes n are distributed in order in the four nozzle formation areas N1 to N4 in accordance with the arrangement order of the dots D in the main-scanning direction X, two nozzle holes n, n that form adjacent dots belong to different nozzle formation areas. With this, it is possible to prevent adjacent location of the nozzle holes, to reduce an influence of resonance caused by the nozzle hole n on the other nozzle hole n, and to prevent reduction in image quality.

However, in the above example of FIG. 5, the order in which the nozzle holes n are allocated in accordance with the arrangement order of the dots and the arrangement order of the nozzle formation areas N1 to N4 in the sub-scanning direction Y match, and therefore, in some cases, two nozzle holes n, n that form dots adjacent in the main-scanning direction are the farthest from each other in the sub-scanning direction Y in the whole area including the four nozzle formation areas N1 to N4.

The above case is, for example, the nozzle hole n of the 32nd dot and the nozzle hole n of the 33rd dot, or the nozzle hole n of the 64th dot and the nozzle hole n of the 65th dot in FIG. 5.

In the case where two nozzle holes n, n that form dots adjacent in the main-scanning direction X are separated from each other in the sub-scanning direction Y as described above and the inkjet head 100 is inclined due to, for example, a mounting error caused when the inkjet head 100 is mounted on the line head 10, 12, 14, or 16, a shift amount of each of the dots D, D in the main-scanning direction X is increased to cause reduction in image quality.

In view of this, in the inkjet head 100 according to the embodiment of the invention, the arrangement order of the nozzle formation areas N1 to N4 formed on the nozzle substrate 1 in the sub-scanning direction Y is changed so that two nozzle holes n, n that form dots D, D adjacent in the main-scanning direction are not separately located at an upstream end in the sub-scanning direction Y and a downstream end in the sub-scanning direction Y within a range including all the nozzle formation areas N1 to N4.

Figure 6:
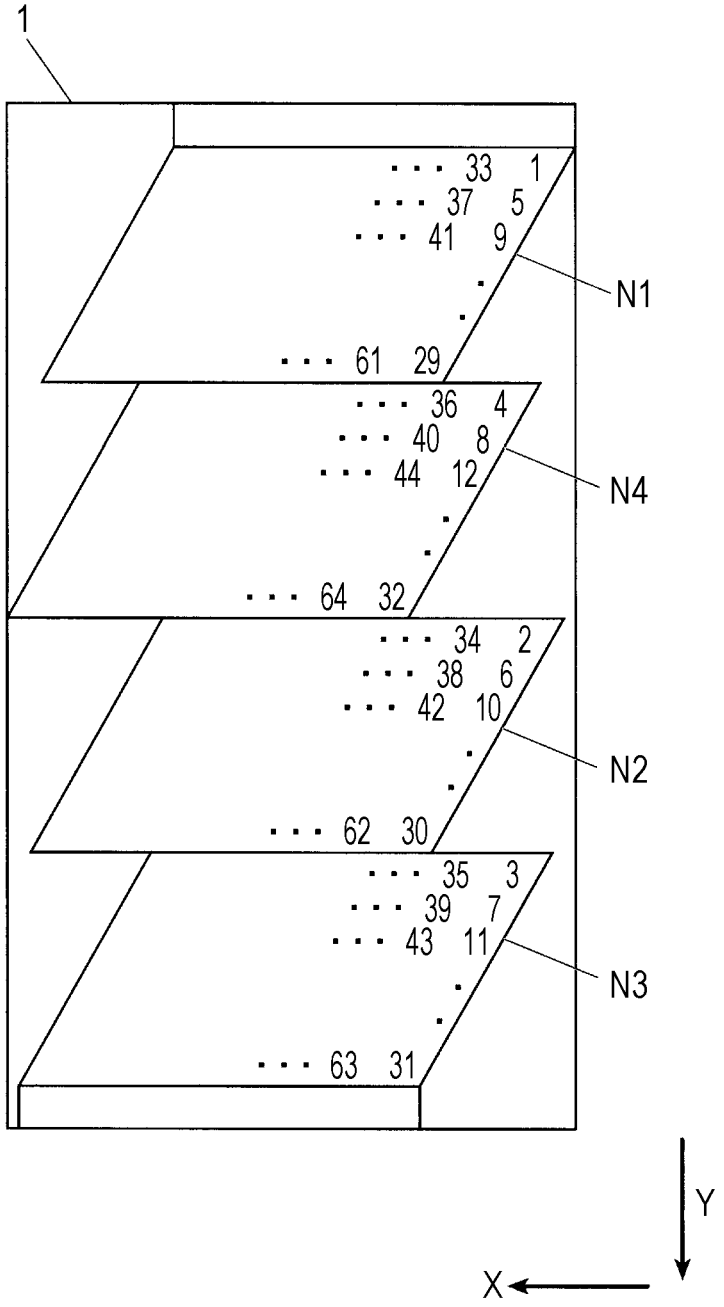
FIG. 6 is a plan view of a nozzle substrate, illustrating location of nozzle holes obtained by changing arrangement order of nozzle formation areas in a sub-scanning direction.

FIG. 6 is a plan view of the nozzle substrate 1, illustrating location of the nozzle holes n obtained by changing the arrangement order of the nozzle formation areas N1 to N4 in the sub-scanning direction Y. In FIG. 6, numbers shown in the nozzle formation areas N1 to N4 indicate location of the nozzle holes n and which dot D counted from an upstream side in the main-scanning direction X the nozzle hole n ejects.

In the nozzle substrate 1 of the inkjet head 100, the nozzle formation areas N1, N4, N2, and N3 are arranged in this order from the upstream side in the sub-scanning direction Y.

In the case of the above order, in a region including all the nozzle formation areas N1 to N4, the nozzle holes n corresponding to the (32k+31)th dots are arranged at an end on the most downstream side in the sub-scanning direction Y, and the nozzle holes n corresponding to the (32k+1)th dots are arranged at an end on the most upstream side in the sub-scanning direction Y (where k=0, 1, 2, 3, . . . ).

Therefore, the nozzle hole n at one end and the nozzle hole n at the other end in the sub-scanning direction in the whole region including the plurality of nozzle formation areas N1 to N4 are located so as not to form dots D adjacent in the main-scanning direction.

Note that the arrangement order of the nozzle formation areas in the sub-scanning direction Y is not limited to the order of N1, N4, N2, and N3 and may be another order unless the nozzle formation area on the most downstream side and the nozzle formation area on the most upstream side in the sub-scanning direction Y match the above order of allocation of the nozzle holes n corresponding to the arrangement order of the dots.

That is, the nozzle formation area on the most downstream side and the nozzle formation area on the most upstream side in the sub-scanning direction Y only need to be arranged in order other than N1-N2, N2-N3, N3-N4, or N4-N1.

[Image Formation in Inkjet Recording Device]

In the case where the inkjet recording device 20 having the above configuration forms an image, the conveyance rollers 8 are driven to convey the recording medium K along the platen 60.

In each of the inkjet heads 100 of the line heads 10, 12, 14, and 16, the piezoelectric elements 5 of the nozzle holes n corresponding to the image to be formed are driven to eject ink, and the dots D are formed.

At this time, the inkjet head 100 synchronously ejects ink through the nozzle holes n in accordance with the image to be formed at a period at which the recording medium K is conveyed by the dot pitch dpy in the sub-scanning direction Y.

Technical Effects of Embodiment of the Invention

As described above, the inkjet recording device 20 includes, on the nozzle substrate 1, the inkjet heads 100 in which two nozzle holes n, n that form dots D, D adjacent in the main-scanning direction X are dispersedly located so as not to be in the same nozzle formation area N1, N2, N3, or N4. Therefore, even in the case where resonance caused by ejection of ink is generated in the nozzle hole n, an influence thereof on other nozzle holes n for ejecting ink can be reduced, and high image quality can be maintained.

Furthermore, in the inkjet head 100, the arrangement order of the nozzle formation areas N1 to N4 in the sub-scanning direction Y on the nozzle substrate 1 is changed so that two nozzle holes n, n that form dots D, D adjacent in the main-scanning direction X are not separately located at one end and the other end in the sub-scanning direction in the whole region including the nozzle formation areas N1 to N4. Therefore, it is possible to reduce an influence of a change in distance between adjacent dots, the influence being caused by a mounting error of the inkjet head 100, and to maintain high image quality.

Furthermore, in the inkjet head 100, the nozzle holes n are allocated to the nozzle formation areas N1 to N4 in accordance with the arrangement order of the dots D in the main-scanning direction X, and the nozzle holes n are arranged in order so as to form a plurality of lines in the second direction in each of the nozzle formation areas N1 to N4. Therefore, it is possible to easily specify which dot in the main-scanning direction corresponds to the nozzle hole n formed at an end in the sub-scanning direction Y in each of the nozzle formation areas N1 to N4, and it is possible to easily determine appropriate arrangement order of the nozzle formation areas N1 to N4 in the sub-scanning direction Y.

[Another Example of Nozzle Formation Areas]

Figure 7:
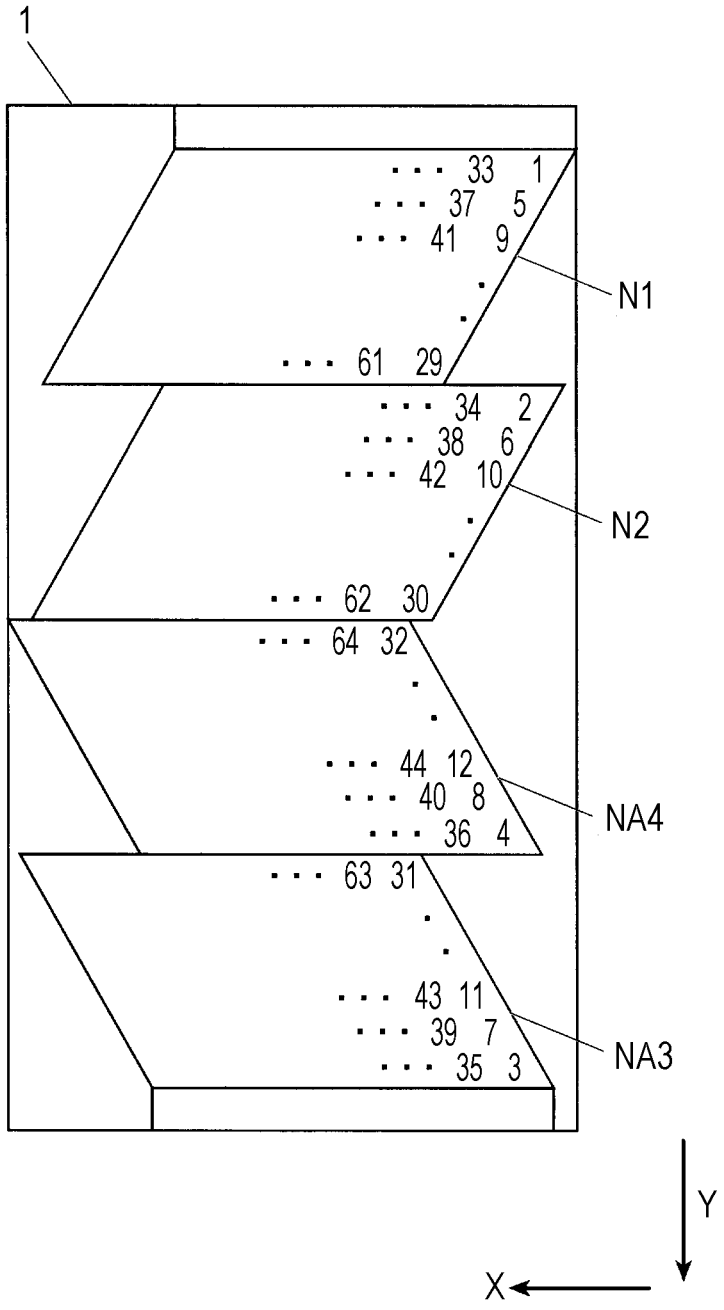
FIG. 7 is a plan view of a nozzle substrate, illustrating another example of nozzle formation areas.
Figure 8:
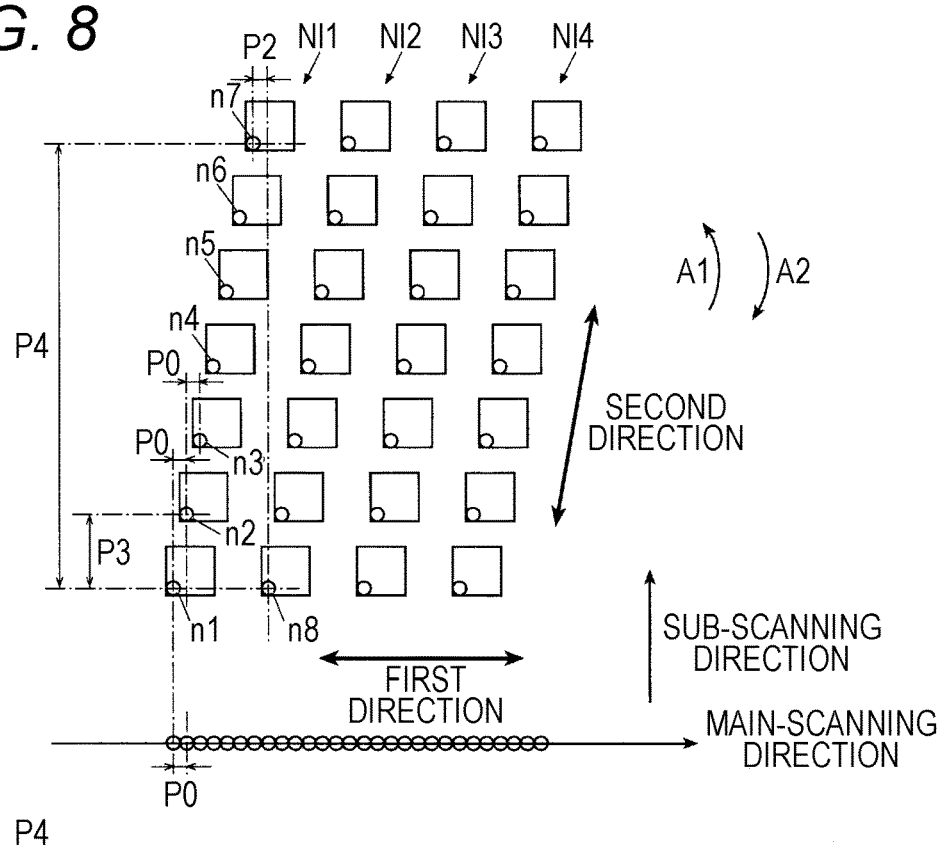
FIG. 8 is an explanatory view illustrating location of nozzle holes of a conventional inkjet head.
Figure 9:
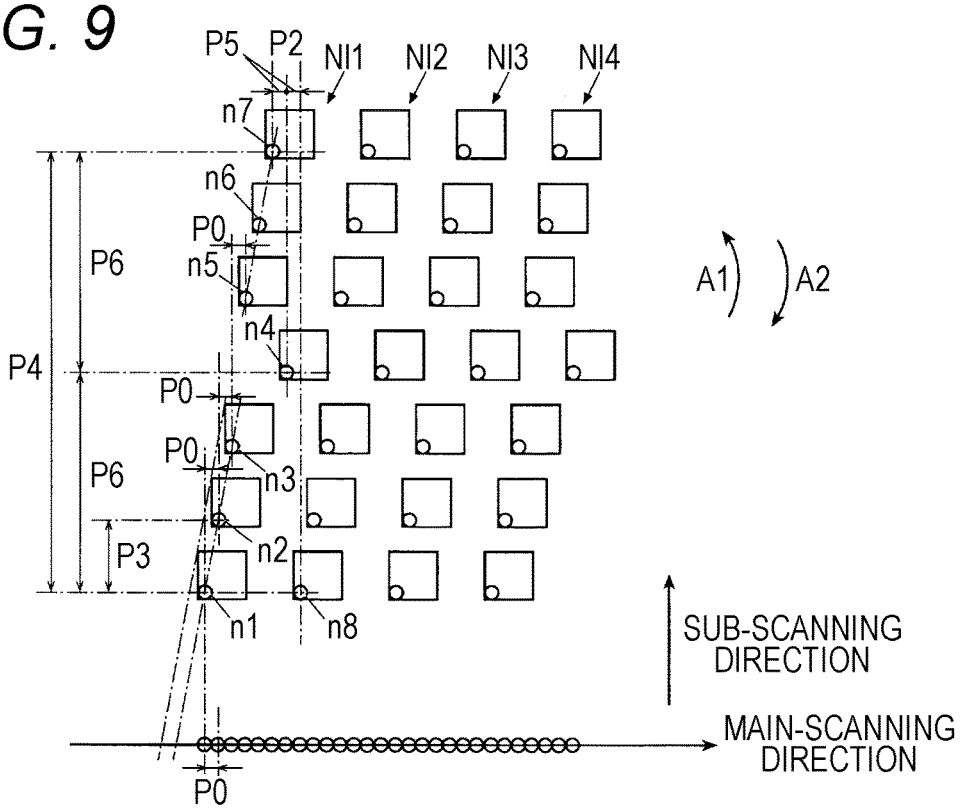
FIG. 9 is an explanatory view illustrating location of nozzle holes of another conventional inkjet head.

In the above embodiment, all nozzle formation areas are provided in the same direction, but directions thereof are not limited thereto. FIG. 7 illustrates another example of the nozzle formation areas. Also in the case of FIG. 7, numbers shown in the nozzle formation areas indicate location of the nozzle holes n and which dot D counted from the upstream side in the main-scanning direction X the nozzle hole n ejects.

In the example of FIG. 7, nozzle formation areas NA3 and NA4, which are obtained by changing the directions of the nozzle formation areas N3 and N4 in FIG. 6, coexist.

That is, the nozzle formation areas NA3 and NA4 are configured such that external forms of the nozzle formation areas N3 and N4 and location of the nozzle holes n are inverted around an axis in the main-scanning direction X. Even in the case where location of the nozzle holes n is inverted as described above, location of the nozzle holes n in the sub-scanning direction Y is not changed, and therefore a correspondence between the order of the dots D and the nozzle holes n in the main-scanning direction X is maintained.

When the nozzle formation areas N1, N2, NA4, and NA3 are located in this order from the upstream side in the sub-scanning direction Y, it is possible to prevent the nozzle holes n, n that form adjacent dots D, D from being located to be adjacent to each other and also to prevent the nozzle holes n, n that form adjacent dots D, D from being separately located at the downstream end and the upstream end in the sub-scanning direction Y in the whole nozzle formation areas N1, N2, NA4, and NA3, as in the example of FIG. 6.

[Others]

Note that the present invention is not limited to the above embodiment, and various improvement and changes in designing may be performed within the scope of the present invention.

For example, an example where four nozzle formation areas having the nozzle holes n are provided in the nozzle substrate 1 in the inkjet head 100 has been described above, but the number of nozzle formation areas can be increased or decreased. However, it is desirable to provide three or more nozzle formation areas and is further desirable to provide four or more nozzle formation areas.

There has been described a preferable example where the plurality of nozzle holes is divided into the plurality of nozzle formation areas in which the nozzle holes are arranged in the first direction and the second direction and two nozzle holes that form dots adjacent in the main-scanning direction are dispersedly located so as not to be in the same nozzle formation area and are located so as not to be adjacent in the sub-scanning direction. However, the present invention is not limited to this example.

It is only necessary that the plurality of nozzle holes be two-dimensionally located in the first direction and the sub-scanning direction, two nozzle holes that form dots adjacent in the main-scanning direction be dispersedly located so as not to be adjacent in the sub-scanning direction, and the two nozzle holes that form the adjacent dots not be separately located at one end and the other end in the sub-scanning direction in a region in which all the nozzle holes that are two-dimensionally located are located. For example, in the above embodiment, two nozzle holes that form dots adjacent in the main-scanning direction may be located in the same area by changing a plurality of nozzle lines extending in the main-scanning direction, or one nozzle formation area may be provided as a whole, as long as the above conditions are satisfied.

An example where the number of nozzle holes n formed in each of the nozzle formation areas N1 to N4 is 8×32 nozzle holes has been described above, but the number of nozzle holes is not limited thereto. The number of nozzle holes n may be increased or decreased in accordance with a dot density that the inkjet head 100 needs to have.

An example where the nozzle formation areas N1 to N4 are located to be close to one another in the sub-scanning direction Y (location in which a nozzle pitch in the sub-scanning direction Y between two nozzle holes n positioned in a boundary between one area and the other area is equal to the nozzle pitch npy in the sub-scanning direction Y between two nozzles adjacent in the same area) has been described above, but location of the nozzle formation areas is not limited thereto. For example, the nozzle formation areas N1 to N4 may be provided to have a gap that is an integral multiple of the nozzle pitch npy.

It should be considered that the embodiment disclosed herein is merely an example in all respects and is not restrictive. The scope of the present invention is defined not by the above description but by Claims, and it is intended to include all modifications within the scope of Claims and the equivalents thereof.

INDUSTRIAL APPLICABILITY

The present invention can be used in an inkjet head and an inkjet recording device.

REFERENCE SIGNS LIST

1 nozzle substrate
2 first adhesion substrate
3 pressure chamber substrate
3*b* diaphragm
3*c* pressure chamber
5 piezoelectric element
6 wiring substrate
20 inkjet recording device
10, 12, 14, 16 line head
11 support member
100 inkjet head
D dot
n nozzle hole
npx nozzle pitch
npy nozzle pitch
N1, N2, N3, N4, NA3, NA4 nozzle formation area
K recording medium
X main-scanning direction
Y sub-scanning direction

The invention claimed is:

1. An inkjet head comprising:

a plurality of nozzle holes that is two-dimensionally located in a nozzle formation surface facing a recording surface of a recording medium in a first direction parallel to a main-scanning direction orthogonal to a conveyance direction of the recording medium and in a sub-scanning direction parallel to the conveyance direction of the recording medium, wherein two nozzle holes that form dots adjacent in the main-scanning direction are dispersedly located so as not to be adjacent in the sub-scanning direction, the two nozzle holes that form dots adjacent in the main-scanning direction are not separately located at one end and the other end in the sub-scanning direction of the plurality of nozzle holes that is two-dimensionally located;

the plurality of nozzle holes is divided into a plurality of nozzle formation areas in which the nozzle holes are arranged in the first direction and in a second direction inclined with respect to the sub-scanning direction, the plurality of nozzle formation areas is arranged in the sub-scanning direction, and the two nozzle holes that form dots adjacent in the main-scanning direction are dispersedly located so as not to be in the same nozzle formation area, and the two nozzle holes that form dots adjacent in the main-scanning direction are not separately located at one end and the other end in the sub-scanning direction in the whole region including the plurality of nozzle formation areas;

the nozzle holes are allocated to the plurality of nozzle formation areas in order in accordance with arrangement order of dots to be formed in the main-scanning direction, and arrangement order of the plurality of nozzle formation areas in the sub-scanning direction is changed so that the two nozzle holes that form dots adjacent in the main-scanning direction are not separately located at the one end and the other end in the sub-scanning direction in the whole region including the plurality of nozzle formation areas;

a nozzle formation area in which the nozzle holes are allocated in order from one end of a line including a plurality of nozzle holes arranged in the second direction coexists with a nozzle formation area obtained by inverting, around an axis in the main-scanning direction, the nozzle formation area in which the nozzle holes are allocated in order from the one end of the line including the plurality of nozzle holes arranged in the second direction.

2. The inkjet head according to claim 1, comprising:

a pressure chamber substrate in which a plurality of pressure chambers individually communicating with the plurality of nozzle holes is provided;

a diaphragm forming a part of inner walls of the plurality of pressure chambers; and a plurality of piezoelectric elements that individually change internal pressures of the plurality of pressure chambers, the piezoelectric elements being provided outside a part of the diaphragm serving as the inner walls of the plurality of pressure chambers.

3. The inkjet head according to claim 1, wherein a nozzle pitch in the main-scanning direction is an integral multiple of a dot pitch in the main-scanning direction, and a nozzle pitch in the sub-scanning direction is an integral multiple of a dot pitch in the sub-scanning direction.

4. An inkjet recording device comprising:

a conveyance mechanism that conveys the recording medium; and the inkjet head according to claim 1.

5. A line head module comprising:

a plurality of the inkjet heads according to claim 1, wherein the plurality of inkjet heads is fixed to a support member in zigzag in a main-scanning direction.

6. An inkjet recording device comprising:

the line head module according to claim 5.

* * * * *